United States Patent [19]

Goldberg

[11] 3,997,170

[45] Dec. 14, 1976

[54] GOLF WOOD, OR IRON, CLUB

[76] Inventor: Marvin B. Goldberg, 7 Oak Park Circle, Lexington, Mass. 02173

[22] Filed: Aug. 20, 1975

[21] Appl. No.: 606,081

[52] U.S. Cl. ..... 273/164; 273/167 A; 273/167 E; 273/174

[51] Int. Cl.[2] ..... A63B 53/04

[58] Field of Search ..... 273/77 R, 78, 163 R, 273/164, 167–175, 183 D; D34/5 GH

[56] References Cited

UNITED STATES PATENTS

| | | | |
|---|---|---|---|
| 1,505,296 | 8/1924 | Smith | 273/167 A |
| 1,531,821 | 3/1925 | Scott | 273/164 X |
| 1,913,821 | 6/1933 | Stumpf | 273/174 X |
| 2,041,676 | 5/1936 | Gallagher | 273/167 A X |
| 2,550,846 | 5/1951 | Milligan | 273/167 E |
| 2,756,055 | 7/1956 | Bittner | 273/174 X |
| 2,859,972 | 11/1958 | Reach | 273/164 |
| 3,468,544 | 9/1969 | Antonious | 273/167 E X |
| D192,515 | 4/1962 | Henrich | 273/167 E X |
| D209,149 | 11/1967 | Sowers | 273/164 X |

FOREIGN PATENTS OR APPLICATIONS

| | | | |
|---|---|---|---|
| 10,736 | 5/1904 | United Kingdom | 273/167 A |
| 244,925 | 12/1925 | United Kingdom | 273/167 A |
| 24,834 | 11/1903 | United Kingdom | 273/167 A |
| 22,113 | 9/1909 | United Kingdom | 273/167 A |

*Primary Examiner*—Richard J. Apley
*Attorney, Agent, or Firm*—Pearson & Pearson

[57] ABSTRACT

A golf club of the wood, or iron, type, as categorized by the U.S. Golf Association, has a head with an intact, flat, planar ball striking face but with a plurality of parallel grooves formed in the upper (or top) face, normal to the striking face to visually indicate the desired direction of stroke. A plurality of parallel grooves are also formed in the lower (or bottom) face, normal to the striking face to reduce air and ground friction. The grooves commence at closed ends, just in rear of the upper and lower front edges, so as not to affect the striking face. The grooves and ribs are below the level of their respective upper or lower faces, opposite each other in equal numbers and cooperate to reduce resistance while having a rudder effect.

7 Claims, 18 Drawing Figures

GOLF WOOD, OR IRON, CLUB

BACKGROUND OF THE INVENTION

It has heretofore been proposed to provide golf putters with various grooves, ribs, weights, and the like in the putter heads to improve accuracy. For example, a single central groove in the upper face of a golf putter, aids in keeping the striking face square to the direction the ball is intended to travel in U.S. Pat. Nos. 2,542,081, 2,957,696, 3,319,962, 3,758,115, and many other patents.

Another line of putter patents not only disclose a single groove in the upper face for sighting purposes but also ribs, runners, or scuff elements projecting from the bottom face as in U.S. Pat. Nos. 1,531,821 to Scott of 1925 and 3,199,873 to Surratt of 1965.

Closed wall recesses are proposed in the bottom face of putters having a sight groove in the upper face in U.S. Pat. Nos. 2,954,231 of 1960 and 3,143,349 of 1964 to MacIntyre, the recesses being for the purpose of reducing weight.

A combined putter and chip iron is proposed in U.S. Pat. No. 3,035,839 to Coglianese of 1962, there being a single sight groove in the upper face and the bottom face having a pair of faces, one angled for putting and the other for chip shots, but there being no grooves in the bottom face.

SUMMARY OF THE INVENTION

This invention is directed only to wood and iron clubs as so designated by the U.S. Golf Association on page 10 of its brochure "The Rules of Golf", effective Jan. 1, 1975, and does not apply to putters used on putting greens. This is for the reason that woods and irons often are used in such manner that the lower front edge not only strikes the ground when stroked, but may dislodge a divot, while anyone putting in such manner on a putting green would be in violation of the rules.

In the wood, or iron, clubs of the invention, unlike the clubs of the prior art, the front, ball-striking face of the club head remains inviolate, so that its upper front edge and its lower front edge are unbroken with the terminal ends of grooves or ribs. The upper face of the club head is provided with a plurality of spaced, generally parallel, grooves below level and forming ribs therebetween, but the forward ends of the grooves are closed and located just in rear of the upper front edge. The grooves preferably flare outwardly and downwardly to open terminal rearward ends at the back of the club head and the grooves are normal (at a 90° angle) to the plane of the ball striking face. Thus, even when the club head is at a considerable distance in front of the player, i.e., when the player addresses the ball, rather than close and easily visible as with a putter, the plurality of parallel grooves with their flared side walls clearly point the direction of the hole in the manner of a set of arrows or lines.

The club heads of the invention also preferably include a plurality of grooves formed in the lower face (or bottom), of the head, all normal (at a 90° angle) to the plane of the striking face, all having closed forward ends just in rear of the lower front edge and all terminating in open ends at the back of the head. Thus, ribs are formed in the material of the lower face which do not interfere with the effect of the ball striking face but serve as rudders, or air foils for guiding the club while reducing the frictional contact with the ground when the head penetrates thereinto. Thus with the same swing force and less ground contact more force will be exerted on the ball, hitting it further with the same effort.

DESCRIPTION OF A PREFERRED EMBODIMENT

Figure 1:
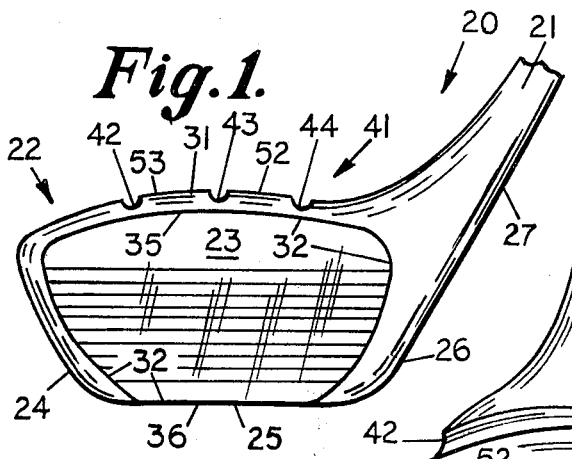
FIG. 1 is a front elevational view of the club head portion of a typical No. 3 wood club of the invention.

As shown in the drawings, a typical wood, or iron, golf club 20, according to the rules of the U.S. Golf Association, is described as having a shaft 21, a club head 22, a club face 23, which is the front, striking face, a toe 24, a sole 25, a back of the heel 26, a neck or socket 27 and a back of head 28.

Each club 20 has an upper face 31, and a sole, or lower face 25, the length thereof being the distance from heel 26 to toe 24 and the breadth thereof being the distance from club face 23 to the back of head 28 all as described on pages 10 and 11 of "The Rules of Golf 1975" published by U.S. Golf Association of Far Hills, New Jersey.

Figure 3:
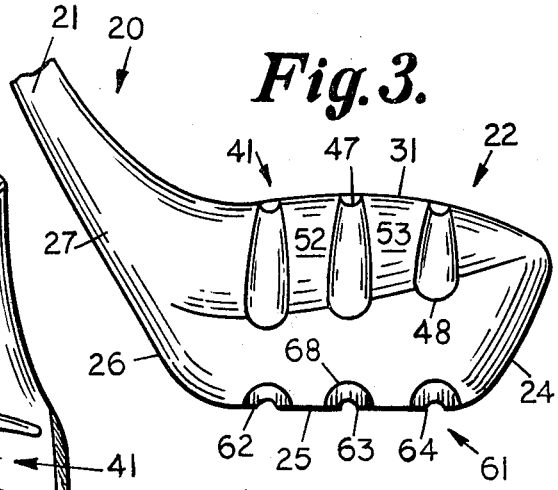
FIG. 3 is a rear elevational view.
Figure 2:
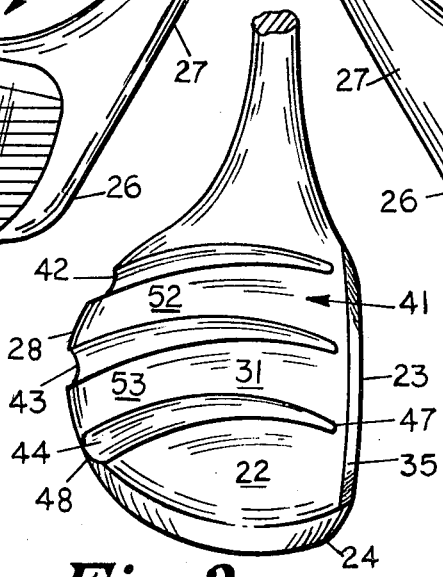
FIG. 2 is a top perspective view.
Figure 4:
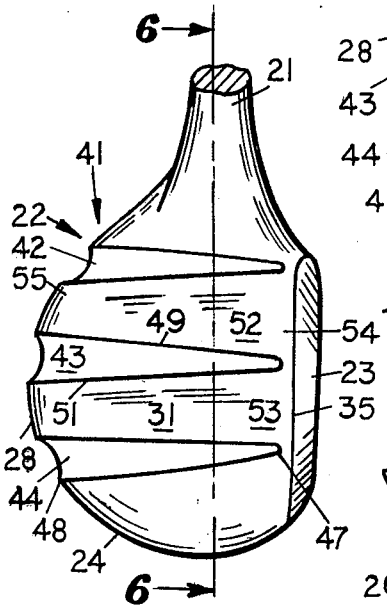
FIG. 4 is a top plan view.
Figure 5:
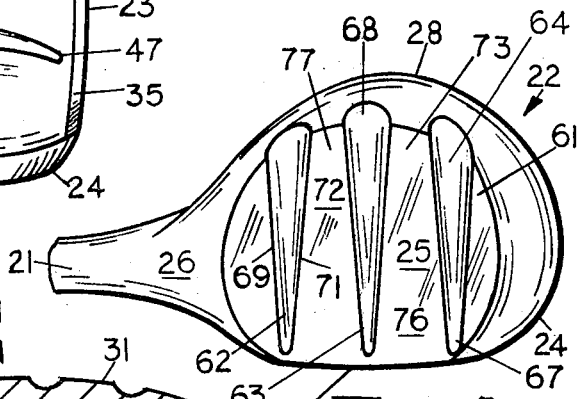
FIG. 5 is a bottom plan view.
Figure 6:
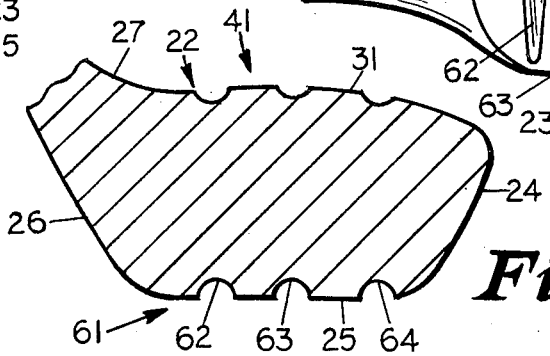
FIG. 6 is a view in section on line 6—6 of FIG. 4, all of the club heads shown in FIG. 1.
Figure 7:
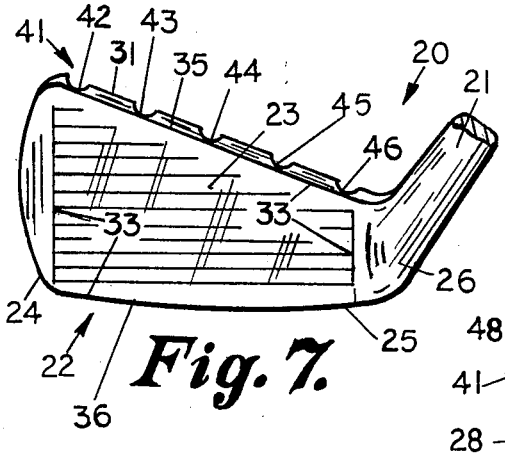
FIG. 7 is a front elevational view of the club head portion of a typical iron such as a No. 2, constructed in accordance with the invention.
Figure 8:
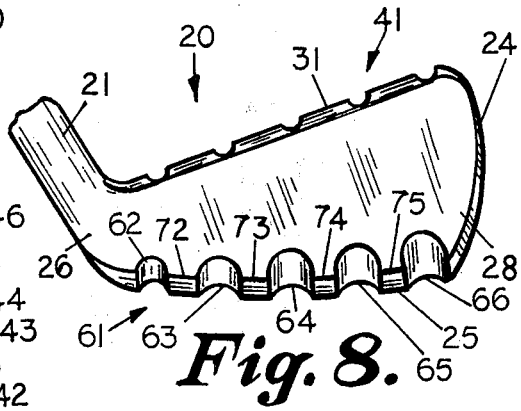
FIGS. 8–12 are views similar to FIGS. 2–7 of the club head of FIG. 7, FIG. 12 being a section on line 12—12 of FIG. 10.
Figure 9:
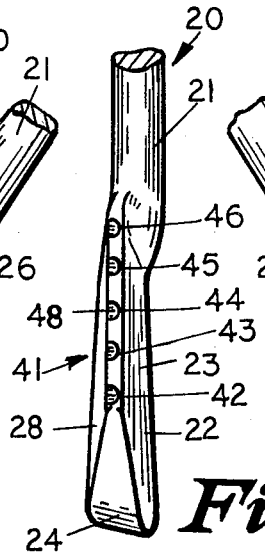
Figure 10:
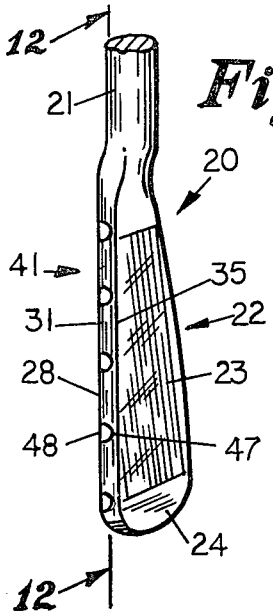
Figure 11:
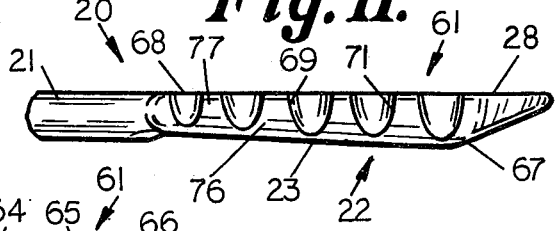
Figure 12:
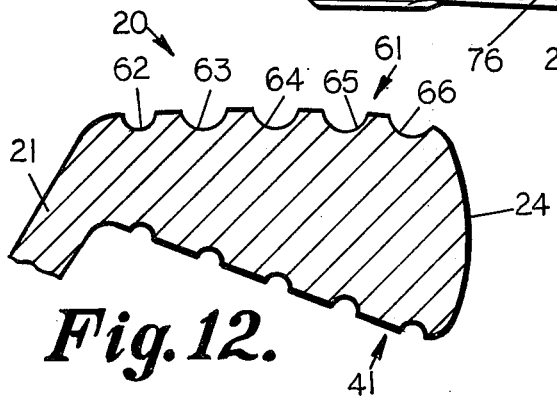
Figure 13:
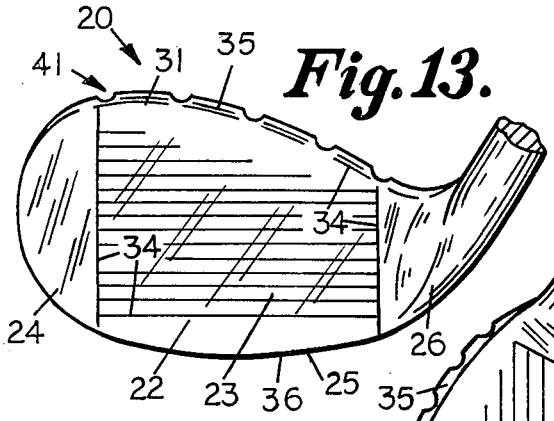
FIG. 13 is a front elevational view of another iron club head, such as a No. 10, or sand wedge, constructed in accordance with the invention.
Figure 14:
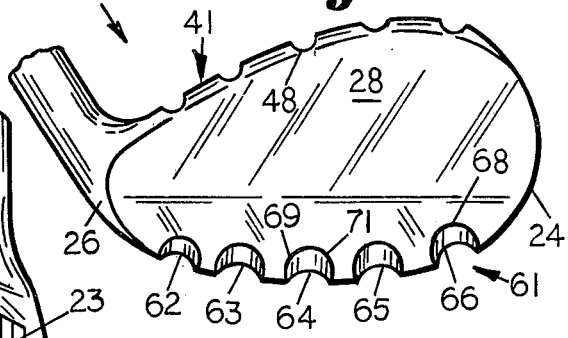
FIGS. 14–18 are views similar to FIGS. 2–7 of the club head of FIG. 13, FIG. 18 being a section on line 18—18 of FIG. 16.
Figure 16:
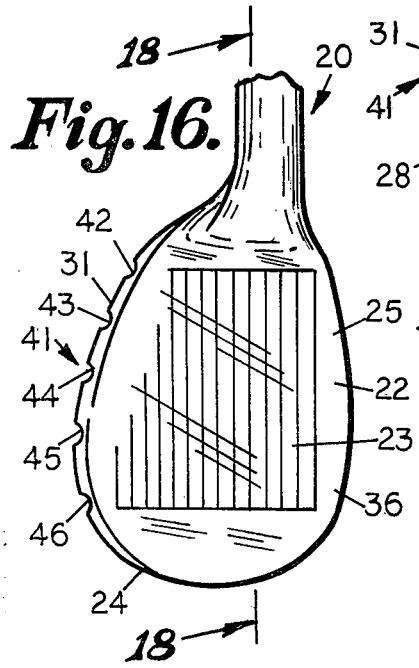
Figure 15:
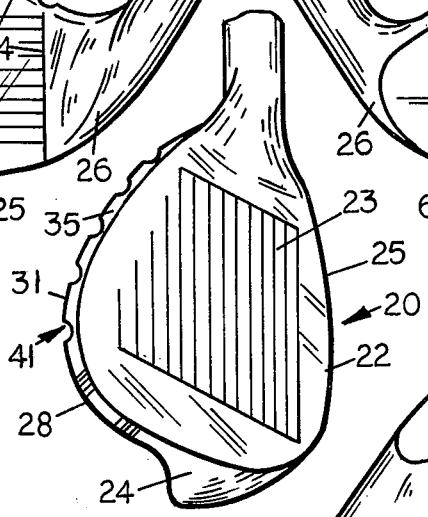
Figure 17:
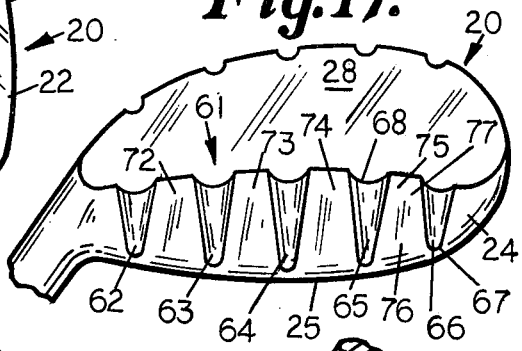
Figure 18:
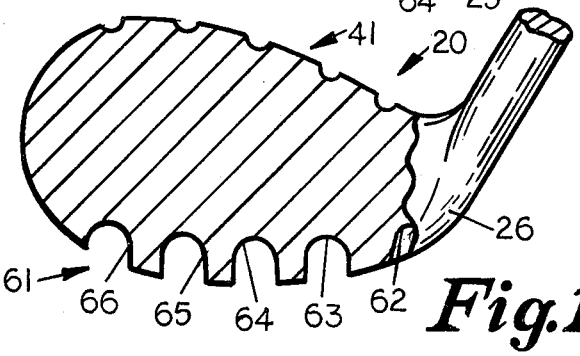

While certain golf clubs of the prior art may propose ribs, grooves, runners or the like which intercept the front, or ball-striking face of the club head, in this invention the front, or ball-striking face 23, of the clubs, whether woods as shown in FIGS. 1–6, or irons as shown in FIGS. 7–18, remain inviolate and are in no way changed or intercepted. In the woods of FIGS. 1–6, the face 23 is defined by a border, or edge 32, and is substantially flat and planar. Similarly in the No. 2 irons of FIGS. 7–12, the face 23 is also flat and planar as outlined by the border 33, and in the No. 10 irons of FIGS. 13–18, the border 34 defines the flat, planar ball-striking, front face 23.

The upper face 31 of the woods is curved as is the upper face of the irons and the lower face, or sole of the irons, but the lower face, or sole of the woods may be flat as shown.

The upper front edge of the ball-striking face 23 of each of the clubs is designated 35 and the lower front edge of the ball-striking face of each of the clubs is designated 36.

Upper rib and groove means 41 includes a plurality of grooves such as 42, 43, 44, 45, or 46, all below the level of the upper face 31 and extending generally in parallelism, in a direction normal (at a 90° angle) to the flat, planar, front, face 23. Each groove extends from a closed, relatively shallow forward end 47, just in rear of the upper front edge 35, to an open relatively deep rearward end 48 at the back of the head 28. Three grooves 42, 43 and 44 are shown in FIGS. 1–6, spaced across the full length of the curved upper face 31 and preferably each groove having a pair of outwardly and downwardly flared side walls 49 and 51 whereby a pair of ribs 52 and 53 are defined therebetween, each rib being of diminishing cross section from front to back of the breadth of the head with the relatively wide forward portion 54 and the relatively narrow rearward portion 55. The ribs 52 and 53 are relatively wide and flat rather than narrow and pointed and do not protrude above their respective upper or lower faces.

The upper rib and groove means 41 of the irons does not have flared grooves, because of the reduced breadth of the upper face, and there are at least three, and preferably five such grooves with ribs therebetween having substantially parallel side walls.

Lower rib and groove means 61 includes a plurality of grooves 62, 63, 64, 65 or 66, all below the level of the lower face, or sole, 25 of each head 22 and all extending generally in parallelism, in a direction normal to the plane of the front, or ball-striking face 23. Each lower groove, like each upper groove, extends from a closed relatively shallow, forward end 67 just in rear of the lower front edge 36 of the head, for the full breadth of the upper face to terminate in an open relatively deep rearward end 68. The grooves and ribs are below the level of their respective upper or lower faces, opposite each other in equal numbers and cooperate to reduce resistance while having a rudder effect. The grooves 62, 63, 64, 65 and 66 in the woods of FIGS. 1–6, and in the No. 10 irons of FIGS. 13–18, have opposite, flared side walls 69 and 71 to form ribs such as 72, 73, 74 or 75 therebetween with relatively wide forward portions 76 and relatively narrow rearward portions 77. However, in the No. 2 irons of FIGS. 7–12, the side walls 69 and 71 are generally parallel because of the reduced breadth of the sole, or lower face 25.

In operation the upper rib and groove means 41 provides a plurality of spaced, sighting lines, for the full length of the upper face of the club head to visually assist the player to be sure that the stroke is toward the hole and that the ball is struck exactly correctly on the "sweet spot" of the club face 23. The lower rib and groove means 61, while in no way interfering with the effect of the club face 23 on the ball will reduce the area of contact with the ground. The ribs and grooves in both upper and lower faces are believed to have an air foil stabilizer, or rudder-like effect in tending to make the club head follow a desired path, with less air resistance. As stated above, the same swing force thus has a reduced portion devoted to contact with the ground and an increased portion available for driving the golf ball.

I claim:

1. A golf club having a head with a front, ball striking face, an upper face with a plurality of grooves and ribs therein, normal to said front face, a lower face with a plurality of grooves and ribs therein, normal to said front face, said club characterized by:

said head having a substantially planar, flat ball striking face with a continuous upper front edge and a continuous lower front edge, an equal number of grooves in said upper and lower faces, each upper groove being opposite a corresponding lower groove, each of said grooves being of U-shaped configuration and below the level of its respective upper or lower face, the forward ends of said grooves in said upper and lower faces being located just in rear of said upper and lower front edges of said ball striking face, said grooves cooperating to reduce resistance to advance of said club head through the air, sand or turf, the webs between adjacent said grooves forming an equal number of ribs in said upper and lower faces, each upper rib being opposite a lower corresponding lower rib, each of said ribs being relatively wide, flat and entirely within the confines of its respective upper or lower face, said ribs cooperating to produce an air foil stabilizer, or rudder-like effect tending to make said club head follow a desired path.

2. A golf club as specified in claim 1 wherein:

each said groove flares outwardly and downwardly from front to back of the club head face and each said rib tapers from a relatively wide forward portion to a relatively narrow rearward portion.

3. A golf club as specified in claim 1 wherein:

said golf club head is an iron and said grooves each have side walls generally in parallelism from front to back.

4. A golf club as specified in claim 1 wherein:

said club head is a wood and said grooves flare outwardly and downwardly from front to back.

5. A golf club head as specified in claim 1 wherein:

said ribs and grooves in said upper face flare outwardly and downwardly from front to back of said upper face.

6. A golf club head as specified in claim 1 wherein:

said ribs and grooves in said lower face have side walls in substantial parallelism from front to back.

7. A golf club as specified in claim 1 wherein:

said grooves in said upper face have side walls which flare outwardly and downwardly from front to back; and said grooves in said lower face have side walls in parallelism with each other.

* * * * *